United States Patent [19]

Niemeyer et al.

[11] 4,072,838

[45] Feb. 7, 1978

[54] ELECTRICAL POWER SWITCH WITH PRESSURIZED GAS BLASTING DEVICE FOR LENGTHENING THE SWITCHING ARC

[75] Inventors: Lutz Niemeyer, Staretschwil; Klaus Ragaller, Neuenhof, both of Switzerland

[73] Assignee: BBC Brown, Boveri & Company Limited, Baden, Switzerland

[21] Appl. No.: 635,351

[22] Filed: Nov. 26, 1975

[30] Foreign Application Priority Data

Dec. 10, 1974 Switzerland ..... 16358/74

[51] Int. Cl.[2] ..... H01H 33/54

[52] U.S. Cl. ..... 200/148 R; 200/147 R; 200/148 BV

[58] Field of Search ..... 200/148 BV, 148 R, 147 R

[56] References Cited

U.S. PATENT DOCUMENTS

| | | | |
|---|---|---|---|
| 3,236,983 | 2/1966 | Frowein | 200/148 BV |
| 3,604,872 | 9/1971 | Wilson | 200/148 BV |
| 3,823,289 | 7/1974 | McConnell et al. | 200/148 BV |

*Primary Examiner*—Robert S. Macon

*Attorney, Agent, or Firm*—Pierce, Scheffler & Parker

[57] ABSTRACT

An electrical power switch operating with a pressurized gas for actuating the switch contacts and also providing a quenching action in which the arc is lengthened and extinguished includes a container in which the pressurized gas is stored, the outlet from this container being located adjacent the junction area between a plurality of contact fingers in fixed position and a movable contact member that also includes a valve member for closing off the gas outlet from the container when the switch contacts are closed. When the movable contact is released for initiating an opening operation of the contacts, the pressure of the gas stored in the container forces the valve open thus releasing the gas for blasting the arc drawn between the contacts. The gas enters an annular chamber surrounding the junction line of the contacts which includes two half-turn helical travel rails of different radius and opposite winding sense to which the feet of the arc are transferred from the contacts and travel downward and into a group of circumferentially spaced nozzles in which the arc is further lengthened.

4 Claims, 6 Drawing Figures

FIG. 3
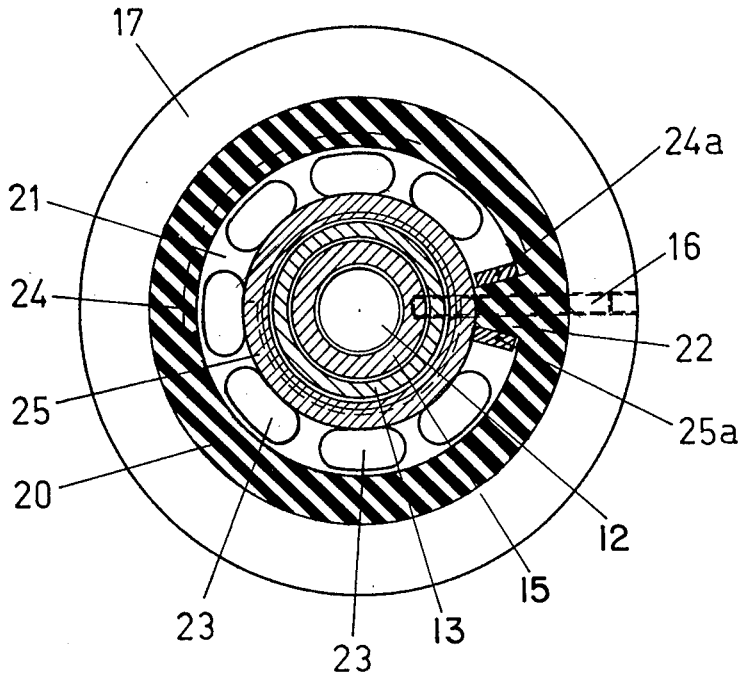
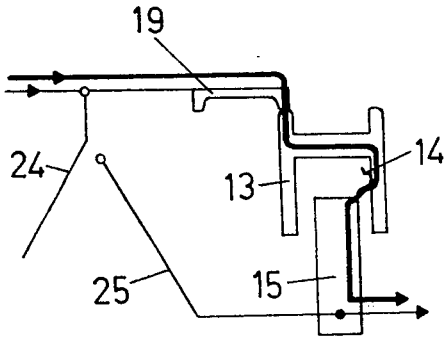
FIG. 4
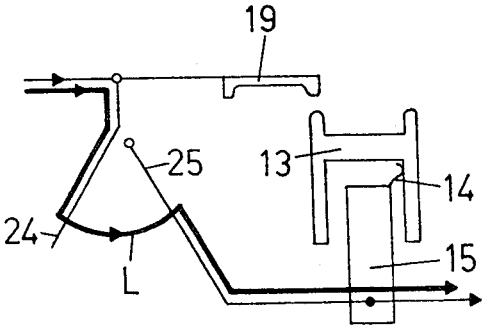
FIG. 5

ELECTRICAL POWER SWITCH WITH PRESSURIZED GAS BLASTING DEVICE FOR LENGTHENING THE SWITCHING ARC

The invention concerns an electric power switch which provides for lengthening of the circuit-breaking arc by blasting it with a pressurized gas.

The published German application DT-AS No. 1,116,769 shows a switch with an arc quenching chamber divided by transverse partitions in which a circuit-breaking arc is lengthened by means of an airflow and divergent rails, utilizing an airflow which is broadened in fan-shape fashion and which drives the feet of the arc along the rails while increasing the arc length or voltage respectively. Also, German patent DT-PS No. 926,146 discloses an arrangement to raise the arc gradient by inducing a stabilized helical shape onto the arc. Finally, there is known, for example from the published German application DT-AS No. 1,540,082, the use of power switches with a working pressure range from 100 to 200 atmospheric absolute pressures for enclosed switch panels under high pressure. These known designs however do not permit the construction of a pressure gas switch for high and ultra-high operating voltages with any significant current-limiting effects.

It is the primary object of the invention to provide such a pressure gas switch. According to the invention, this can be attained by the collective utilization of the following features:

a. the quenching gas is stored under very high pressure in an intermediate container, its cubic capacity designed for at least one circuit breaking operation.

b. travel rails for the arc feet are provided in a slotted area, with the arc lengthening taking place at these rails under the influence of the pressure gas flow, c. a multitude of insulating nozzles are provided for the subsequent, additional arc lengthening, d. the quenching gas serves simultaneously for the drive of the moving switch part.

Figure 1:
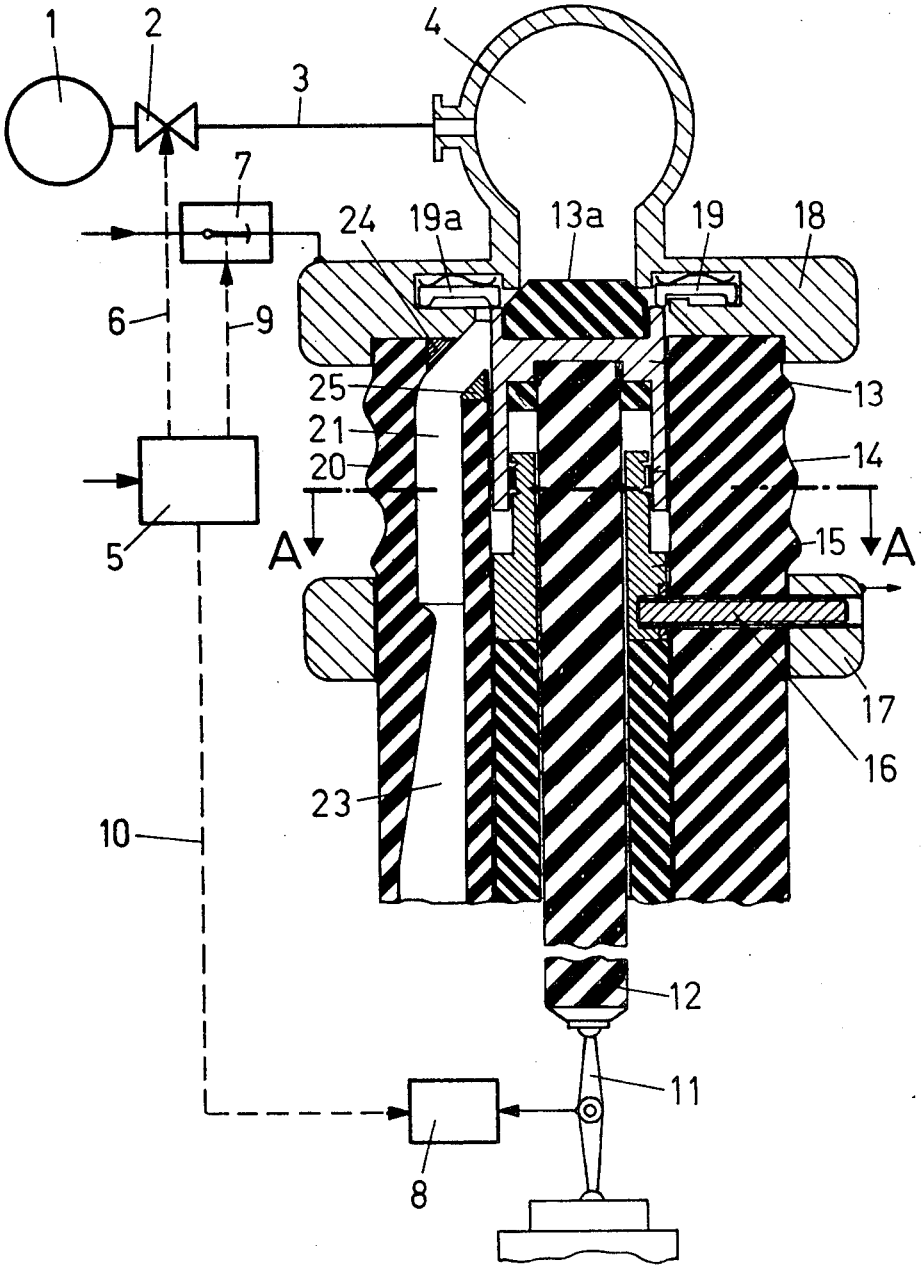
Figure 2:
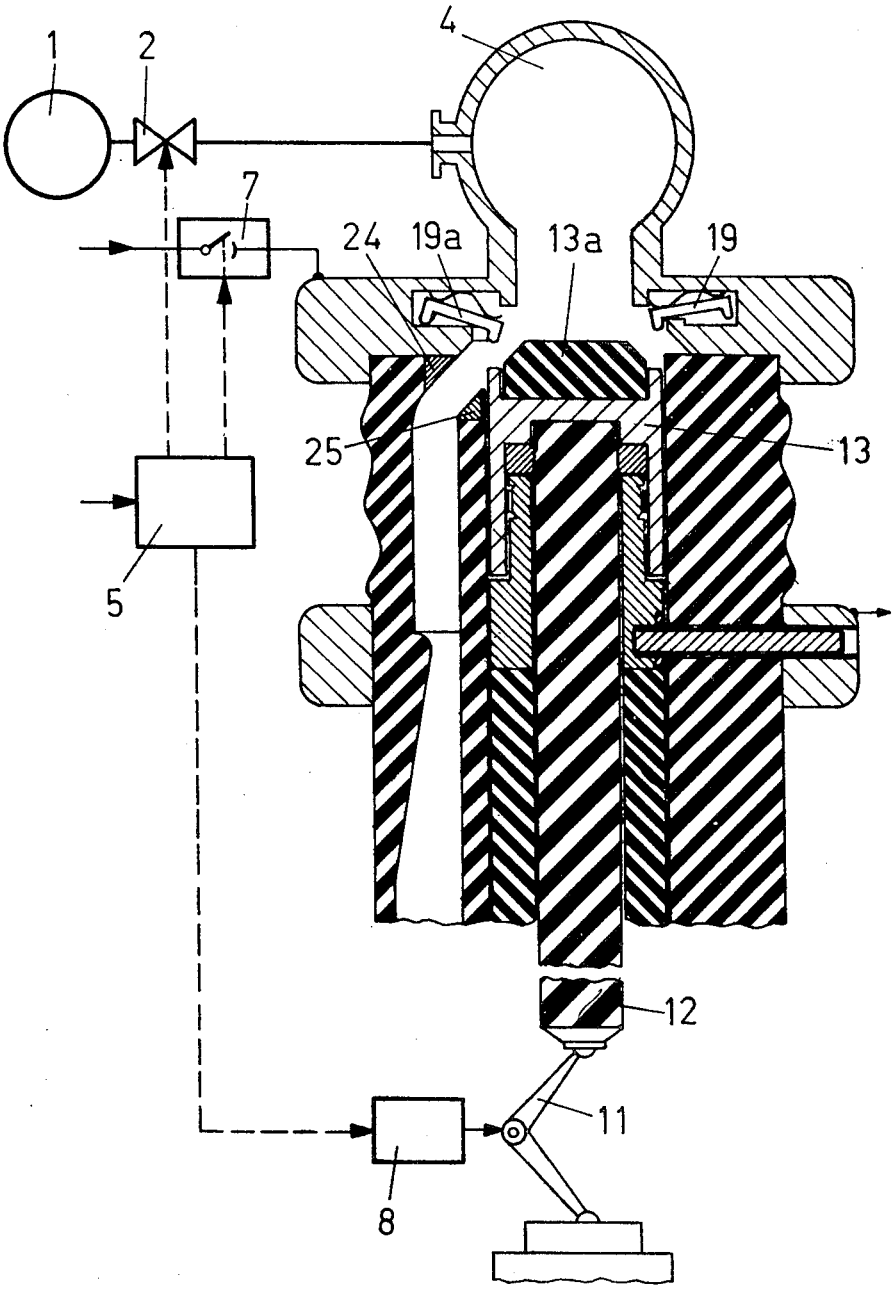
Figure 6:
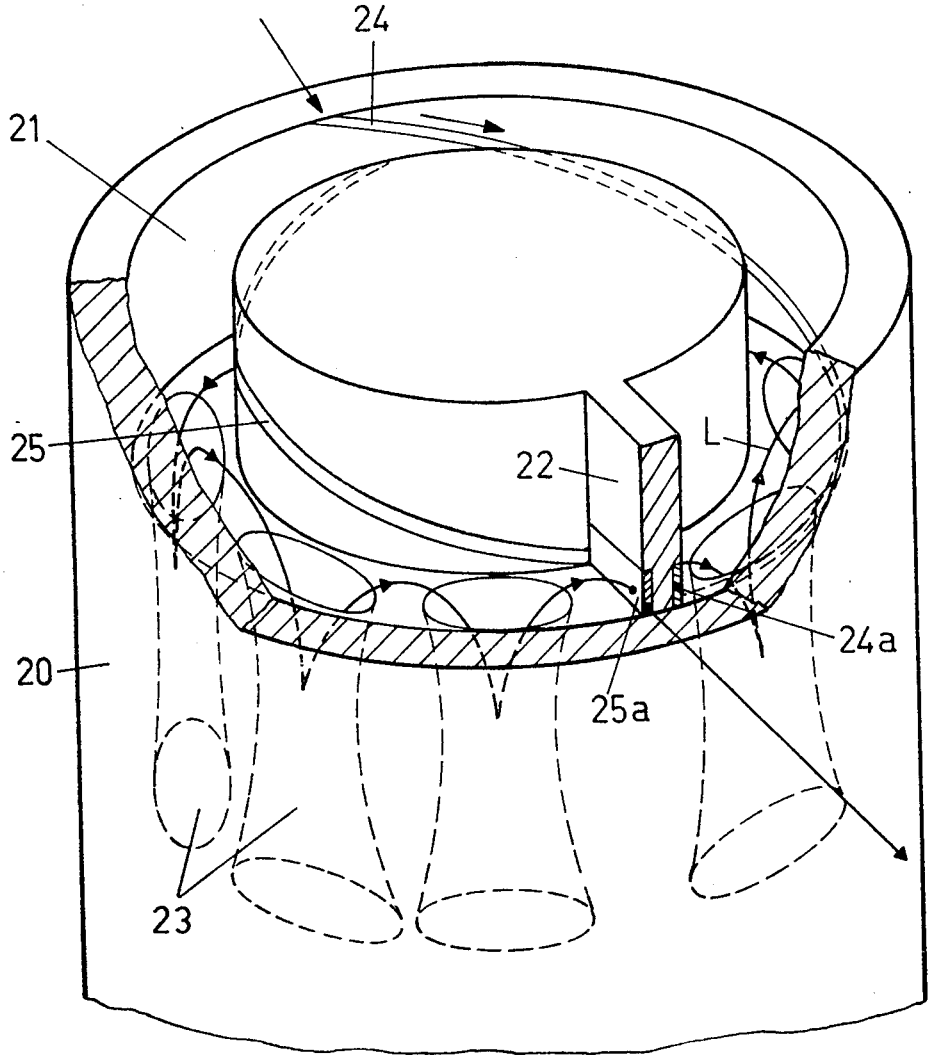

A preferred embodiment of a power switch according to the invention is illustrated in the accompanying drawings wherein:

FIG. 1 shows in partial longitudinal cross-section the switch in its closed i.e. "on" position, FIG. 2 shows the corresponding disconnect or "off" position, FIG. 3 shows a horizontal section along line A—A in FIG. 1, FIGS. 4 and 5 give a diagrammatic view of the current flow through the switch in the "on" or quenching position respectively, and FIG. 6 shows the interior of one portion of the switch chamber in perspective and schematical form.

Corresponding parts are denoted in the various figures by identical reference numerals. Numeral 1 in FIG. 1 denotes a source for compressed air which can be connected with the intermediate tank 4 of the switch by way of a controllable valve 2 and the pipe 3. The valve 2 can be commanded by the control unit 5 as indicated by the action line 6. The control unit 5 can also command a high-voltage series connected isolating switch 7 and the switch drive 8 respectively, as indicated by the dashed lines 9 and 10 respectively. The drive 8 is connected with the moving switch part 13 by way of the knee joint system 11 and the insulating rod 12. The switch part 13 embraces with its bell-shaped lower part by way of the sliding contact 14 the upper portion of the contact piece 15 which is electrically connected to the lower flange 17 by the bolt 16. The switch part 13 carries at its top the seal **13*a* which interacts with a seat worked into the upper flange 18. Into the flange 18 there are inserted contact fingers 19 of which one finger 19*a* is designed as the last-opening finger. In the "on" position shown by FIG. 1 the contact fingers 19 engage the switch part 13. The current will then flow, as indicated by the arrows, through the closed isolating switch 7, the flange 18, the switch contact components 19, 13, the sliding contact 14, the contact piece 15 and the bolt 16 of the lower flange 17. At this time the intermediate tank 4, filled with air under high pressure of for example 150 atmospheres, is closed off by the seal 13*a* because the knee joint system 11 is kept in a straightened position by the drive 8, and the chamber 20 is under no pressure. The construction of this chamber is described by use of FIGS. 3 and 6. It consists primarily of insulating material and has within its upper portion an annular space 21 which is divided by the wall 22. Within the lower portion of the chamber 20 there are inserted a great number of insulating nozzles 23, with their outflow going into the free atmosphere. Into the inner, or respectively the outer wall of the chamber 20 there are inserted within its upper portion the arc travel rails 24 and 25 respectively thusly that the surfaces of the rails 24, 25 which face each other will remain metallically uncovered. The shape of the rails is represented very closely by half of a screw thread with an opposite sense of winding. The upper ends of the rails 24, 25 are in close proximity to the last-opening finger 19*a* (see FIG. 1). The lower ends of rails 24 and 25 respectively change in front of wall 22 (FIG. 3) into plates 24*a* and 25*a* respectively, with the plates protruding into the annular space 21. The lower end of rail 25 is electrically connected with the bolt 16, and thus with the flange 17, as shown in FIG. 3. FIG. 6 depicts by means of arrows the air flow within the chamber 20 at a specific period of time just prior to the arc quenching. It can be seen that the flow enters the rail 24 at the top, reaches the plate 25*a* by way of 24*a* and the arcs L by plunging into the insulating nozzles 23, arriving at the outside by way of bolt 16 and flange 17 (see FIG. 1**).

FIG. 2 shows the "off" position of the switch, with the switch part 13 in its lower limit position. The seal 13a is removed and the intermediate tank 4 is without pressure. The valve 2 is closed and the isolating switch 7 is open. In order to return the switch to its position as shown by FIG. 1, the drive 8 is commanded to the switching-on direction, and as soon as the seal **13*a* is in place, valve 2 is opened to fill the tank 4 with compressed air, and the isolating switch 7 is then closed. FIGS. 4 and 5 illustrate, in the form of a circuit diagram the current flow through the switch (with the isolating switch 7 omitted) in the "on" state (FIG. 4) and in the instantaneous state during the quenching (FIG. 5). Upon the opening of the switch contact components 13, 19 the arc L is lengthened in the manner illustrated by FIG. 6 under the effect of the highly compressed air of at least 150 atmospheres emerging at this time from the intermediate tank 4. The arc commutates first during the opening of the switch components 13, 19a with its feet onto the rails 24, 25 which guide the feet down to the plates 24*a*, 25*a*. At these plates there takes place (FIG. 6) the arcade-like influencing of the arc by forcing it into the insulating nozzles 23**. The result of this action is a current-limiting effect and quenching due to the pronounced increase in the arc voltage.

The isolating switch 7 will provide the necessary voltage distance after the quenching operation.

We claim:

1. In an electric power switch which provides for lengthening of the circuit-breaking arc by blasting it with a pressurized gas the improvement characterized by the following features in combination:

a. the quenching gas is stored under very high pressure in an intermediate tank, its cubic capacity designed for at least one circuit-breaking operation, b. travel rails for the arc feet are provided in an annular space, with the arc lengthening taking place at these rails under the influence of the flow of the pressurized gas, c. a multitude of insulating nozzles are provided for the subsequent, additional arc lengthening, d. the quenching gas serves simultaneously for the drive of the movable switch contact part.

2. An electrical power switch as defined in claim 1 wherein the pressurized gas used for blasting the arc and quenching it is compressed air at a pressure level of at least 100 atmospheres.

3. An electrical power switch as defined in claim 1 wherein said travel rails for the arc feet have a helical configuration of one-half a turn, the winding radius of one rail being different from that of the other and being of an opposite winding sense, said rails being insulated from each other at the current leaving end and the current entering ends of said rails terminating in the direct vicinity of the last to open switch contacts.

4. In an electrical power switch structure the combination comprising a contact enclosing chamber made from insulating material, stationary and movable contact members located within said chamber, a tank on said switch structure for storing a pressurized arc-quenching gas and which has a cubic capacity sufficient for at least one circuit-breaking operation, means actuated by said quenching gas for effecting movement of said movable member away from said stationary contact member, means forming an annular space within said chamber surrounding said movable contact member, said annular space being provided with travel rails for the feet of the arc and which is lengthened under the influence of the flow of pressurized gas from said storage tank into said space when said movable contact member is disengaged from said stationary contact member, and a circumferential array of nozzles formed in the body of said chamber and which lead from said annular space to the exterior of the switch for subsequent additional lengthening of the arc.

* * * * *